US010988889B2

(12) United States Patent
Bensel et al.

(10) Patent No.: US 10,988,889 B2
(45) Date of Patent: Apr. 27, 2021

(54) ADDITIVE DISPENSER FOR DISSOLVING AN ADDITIVE POD WITHIN A WASHING APPLIANCE

(71) Applicant: Haier US Appliance Solutions, Inc., Wilmington, DE (US)

(72) Inventors: Peter Hans Bensel, Louisville, KY (US); Karlarrious Dawain Donar, Jr., Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 70 days.

(21) Appl. No.: 16/139,147

(22) Filed: Sep. 24, 2018

(65) Prior Publication Data

US 2020/0095720 A1 Mar. 26, 2020

(51) Int. Cl.
*D06F 39/02* (2006.01)
*A47L 15/44* (2006.01)

(52) U.S. Cl.
CPC ..... *D06F 39/028* (2013.01); *A47L 15/4436* (2013.01)

(58) Field of Classification Search
CPC ..... D06F 39/28; A47L 15/4436
See application file for complete search history.

(56) References Cited

U.S. PATENT DOCUMENTS 9,976,246 B2 5/2018 Malheiros
2010/0071777 A1* 3/2010 Smith ..... D06F 39/022 137/14
2010/0300157 A1* 12/2010 Schulze ..... D06F 39/02 68/17 R
2016/0237612 A1* 8/2016 Ghosh ..... D06F 39/028
2017/0350060 A1 12/2017 Favaro et al.

FOREIGN PATENT DOCUMENTS

CN 106222957 A * 12/2016
EP 2365120 B1 3/2012
EP 2597190 A1 * 5/2013 ..... D06F 39/022
EP 2649231 B1 10/2015
EP 2813612 B1 12/2016
EP 2654546 B1 9/2017
EP 3237671 A1 11/2017
EP 3290568 A1 3/2018

OTHER PUBLICATIONS

EP2597190—Machine Translation (Year: 2013).*
CN106222957—Machine Translation (Year: 2016).*

* cited by examiner

*Primary Examiner* — Marc Lorenzi
(74) *Attorney, Agent, or Firm* — Dority & Manning, P.A.

(57) ABSTRACT

An additive dispenser of a washing appliance is provided herein. The additive dispenser may include a water inlet and a drawer frame. The water inlet may be positioned upstream from a wash chamber. The drawer frame may define a compartment to receive an additive pod. The compartment may be positioned in downstream fluid communication with the water inlet. The drawer frame may include a sidewall at least partially enclosing the compartment.

10 Claims, 11 Drawing Sheets

ADDITIVE DISPENSER FOR DISSOLVING AN ADDITIVE POD WITHIN A WASHING APPLIANCE

FIELD OF THE INVENTION

The present subject matter relates generally to automated washing appliances, such as washing machine appliances, and more particularly to an additive dispenser for dissolving an additive pod within a washing appliance.

BACKGROUND OF THE INVENTION

Modern washing appliances, such as washing machine appliances and dishwasher appliances, often include an additive dispenser to dispense a wash fluid therefrom. Prior to use of a washing appliance, a wash additive, such as detergent, may be placed within the additive dispenser (e.g., by a user) to be selectively added to a wash chamber during a wash cycle of the appliance. For example, washing machine appliances generally include a tub for containing water or wash fluid (e.g., water and detergent, bleach, or other wash additives), as well as a basket that is rotatably mounted within the tub and defines a wash chamber for receipt of articles for washing. During normal operation of such washing machine appliances, the wash liquid is directed into the tub and onto articles within the wash chamber and basket.

Increasingly, there is a desire by consumers to use discrete additive pods with washing appliances. The additive pods are often filled with a premeasured volume of one or more wash additives (e.g., detergents, softeners, rinse aids, etc.). For instance, a granular wash additive and liquid wash additive may both be encased within a water-soluble casing to form a discrete additive pod. Since they are generally self-contained and eliminate the need for measuring exact amounts of wash additives, additive pods may make using a washing appliance easier. Moreover, use of an additive pod may ensure that the correct amount of wash additive is used for a given wash load.

In spite of these advantages, using additive pods can also present certain drawbacks. For example, in some systems, it may be difficult to ensure that the additive pod dissolves completely. This may be especially true during a cold-water wash cycle. If the additive pod does not dissolve completely, remnants of the additive pod may accumulate within the additive dispenser. Along with being unsightly, the residue may degrade performance of the appliance over time. Moreover, the residue is generally wasteful since it can result in some volume of the wash additive not being used for an intended wash cycle.

As a result, there is a need for improved additive dispensers. In particular, it would be advantageous to provide an additive dispenser for a washing appliance that can ensure improved dissolution of an additive pod during a wash cycle.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an additive dispenser of a washing appliance is provided. The additive dispenser may include a water inlet and a drawer frame. The water inlet may be positioned upstream from a wash chamber. The drawer frame may define a compartment to receive an additive pod. The compartment may be positioned in downstream fluid communication with the water inlet. The drawer frame may include a sidewall at least partially enclosing the compartment. The sidewall may extend along a transverse direction between a front end and a rear end. The sidewall may extend along a lateral direction between a first side and a second side. The front end may define a pair of adjacent concave surfaces facing the compartment. The pair of adjacent concave surfaces may form an interior wedge positioned rearward relative to a concave vertex of each concave surface. The rear end may define a wash fluid outlet positioned in fluid communication between the compartment and the wash chamber.

In another exemplary aspect of the present disclosure, an additive dispenser of a washing appliance is provided. The additive dispenser may include a water supply conduit and a drawer frame. The water supply conduit may define a water inlet positioned upstream from a wash chamber. The drawer frame may define a compartment. The drawer frame may be horizontally slidable relative to the water supply conduit between an open position and a closed position. The open position may permit receipt of an additive pod. The closed position may permit greater receipt of the water supply conduit than the open position. The compartment may be positioned in downstream fluid communication with the water inlet. The drawer frame may include a sidewall at least partially enclosing the compartment. The sidewall may define a horizontal aperture to receive the water supply conduit therethrough.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
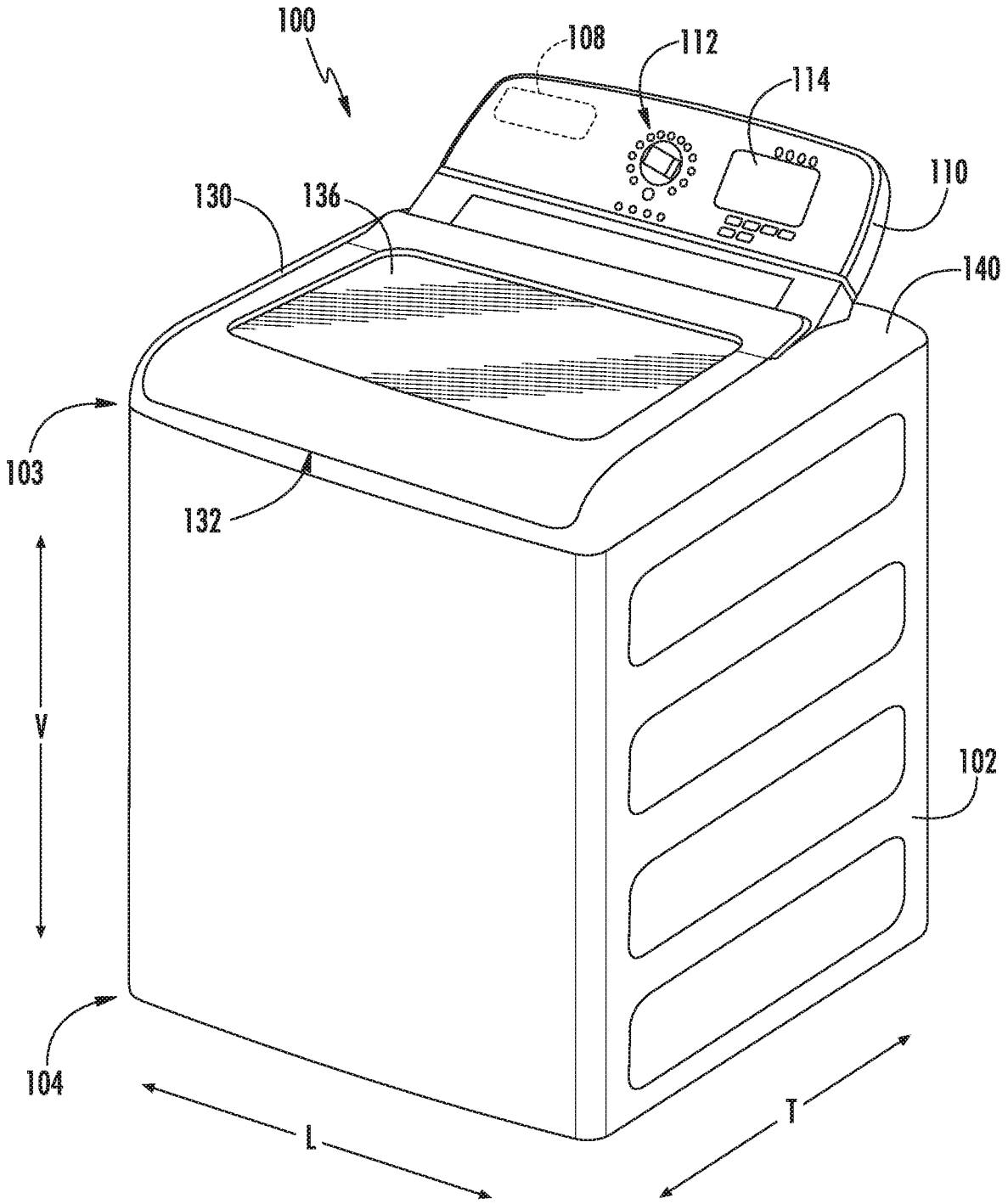
FIG. 1 provides a perspective view of a washing machine appliance according to exemplary embodiments of the present disclosure with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
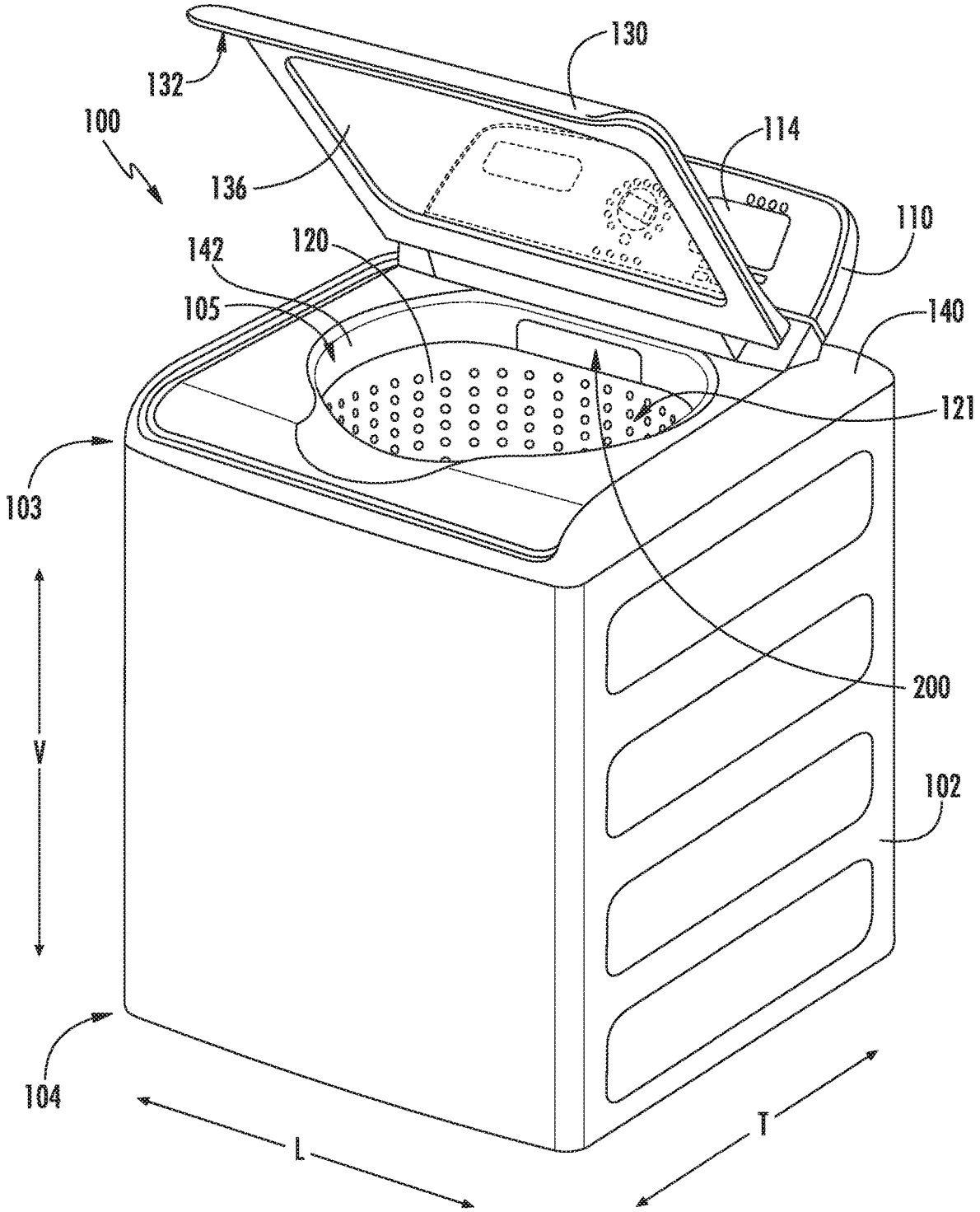
FIG. 2 provides a perspective view of the exemplary washing machine appliance of FIG. 1 with the door shown in an open position.
Figure 3:
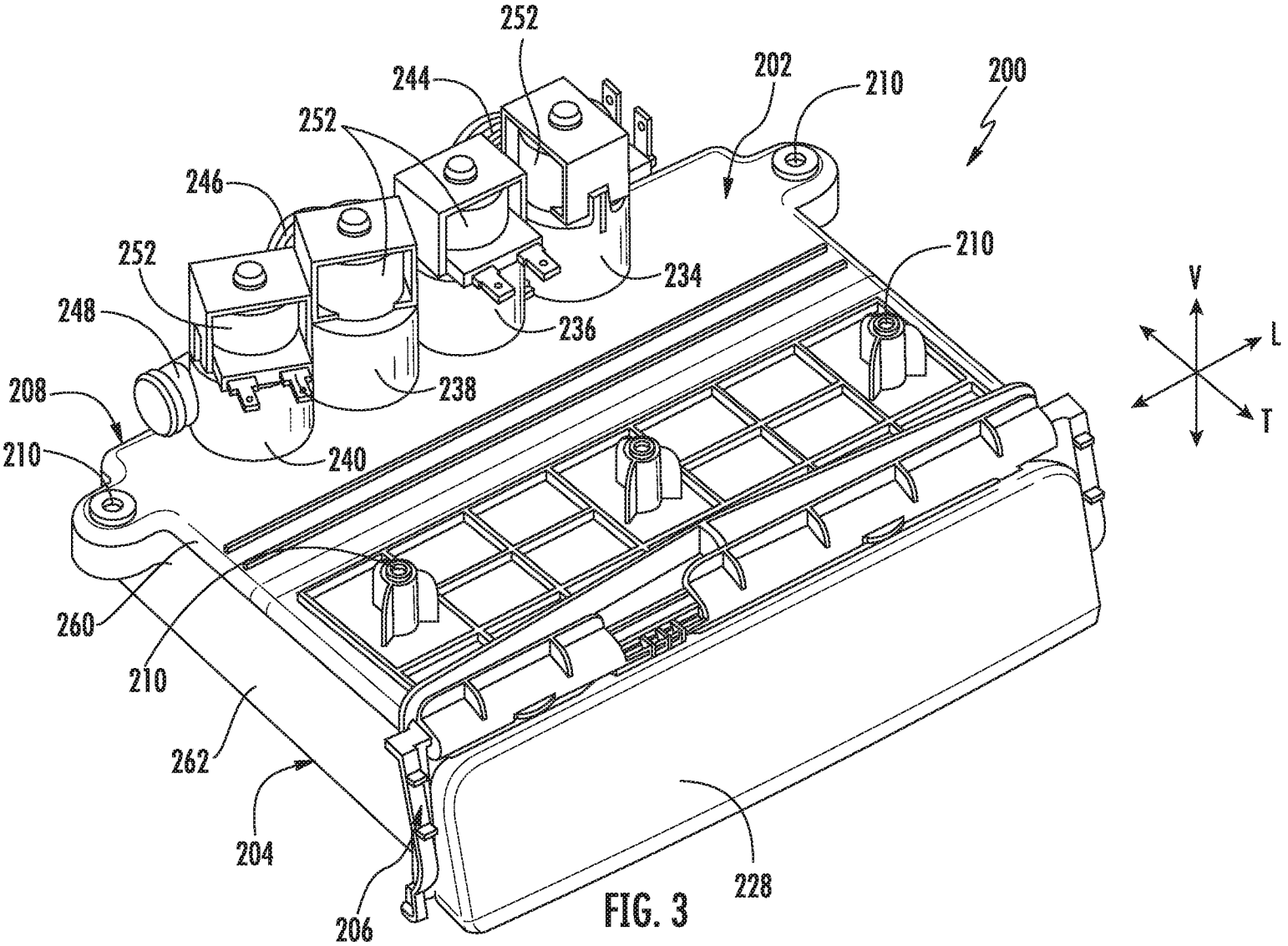
FIG. 3 provides a front, perspective view of an additive dispenser according to exemplary embodiments of the present disclosure.

Turning now to the figures, FIGS. 1 and 2 illustrate an exemplary embodiment of a washing appliance. Specifically, the washing appliance is illustrated as a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is defined.

While described in the context of a specific embodiment of vertical axis washing machine appliance 100, using the teachings disclosed herein it will be understood that vertical axis washing machine appliance 100 is provided by way of example only. Other washing appliances having different configurations, different appearances, or different features may also be utilized with the present subject matter as well (e.g., horizontal axis washing machines, dishwashing appliances, etc.).

Washing machine appliance 100 has a cabinet 102 that extends between a top portion 103 and a bottom portion 104 along the vertical direction V. A wash basket 120 is rotatably mounted within cabinet 102. A motor (not shown) may be in mechanical communication with wash basket 120 to selectively rotate wash basket 120 (e.g., during an agitation or a rinse cycle of washing machine appliance 100). Wash basket 120 is received within a wash tub or wash chamber 121 and is configured for receipt of articles for washing. The wash tub 121 holds wash and rinse fluids for agitation in wash basket 120 within wash tub 121. In optional embodiments, an agitator or impeller (not shown) extends into wash basket 120 and is also in mechanical communication with the motor. The impeller may assist agitation of articles disposed within wash basket 120 during operation of washing machine appliance 100.

In some embodiments, cabinet 102 of washing machine appliance 100 has a top panel 140. Top panel 140 defines an opening 105 that permits user access to wash basket 120 of wash tub 121. Door 130, rotatably mounted to top panel 140, permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In optional embodiments, a window 136 in door 130 permits viewing of wash basket 120 when door 130 is in the closed position (e.g., during operation of washing machine appliance 100). Door 130 also includes a handle 132 that, for example, a user may pull or lift when opening and closing door 130. Further, although door 130 is illustrated as mounted to top panel 140, alternatively, door 130 may be mounted to another portion of cabinet 102 or any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation. Operation of washing machine appliance 100 may be controlled by a controller or processing device 108 connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

In some embodiments, during operation of washing machine appliance 100, laundry items are loaded into wash basket 120 through opening 105, and a washing operation is initiated through operator manipulation of input selectors 112. Wash basket 120 is filled with water and detergent or other fluid additives via an additive dispenser 200, which will be described in detail below. One or more valves can be controlled by washing machine appliance 100 to provide for filling wash basket 120 to the appropriate level for the volume or number of articles being washed or rinsed. By way of example for a wash cycle, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through opening 105).

Referring now generally to FIGS. 2 through 5, additive dispenser 200 will be described in more detail. Although the discussion below refers to additive dispenser 200, one skilled in the art will appreciate that the features and configurations described may be used for other additive dispensers in other washing appliances as well. For example, additive dispenser 200 may be positioned on a front of cabinet 102, may have a different shape or chamber configuration, and may dispense water, detergent, or other additives. Other variations and modifications of the exemplary embodiment described below are possible, and such variations are contemplated as within the scope of the present subject matter.

In exemplary embodiments, additive dispenser 200 generally forms a box (e.g., having a substantially rectangular cross-section) that defines a top 202 and a bottom 204 spaced apart along the vertical direction V. Additive dispenser 200 also defines a front side 206 and a back side 208 spaced apart along the transverse direction T. In certain embodiments, additive dispenser 200 includes an upper shower plate 260 fixed to a lower base plate 262, which together selectively enclose or receive a drawer frame 212.

In some embodiments, additive dispenser 200 is mounted underneath top panel 140 of cabinet 102 such that front side 206 is visible inside opening 105. More specifically, additive dispenser 200 may be mounted to top panel 140 using a plurality of mounting features 210, which may, for example, be configured to receive mechanical fasteners. One skilled in the art will appreciate that additive dispenser 200 may be mounted in other locations and use other mounting means according to alternative exemplary embodiments.

As shown, additive dispenser 200 may include or define a mixing chamber 220 configured to receive one or more additive compartments. For example, according to the illustrated embodiment, mixing chamber 220 is defined by shower plate 260 and base plate 262. Together, shower plate 260 and base plate 262 are configured to slidably receive a detergent compartment 222, a softener compartment 224, or a pod compartment 225. In some embodiments, compartments 222, 224, 225 are slidably connected to the mixing chamber 220 (e.g., as part of a drawer frame 212 having laterally-positioned slides 226) and are connected to a front panel 228 of additive dispenser 200. In certain embodiments, the drawer frame 212 is fixed to front panel 228 (e.g., to slide therewith along the transverse direction T). In this manner, a user may pull on front panel 228 to slide compartments 222, 224, 225 or drawer frame 212 along the transverse direction T from a closed position (e.g., FIG. 3) to an open position (e.g., FIG. 5). Once extended, detergent compartment 222, softener compartment 224, or pod compartment 225 may be conveniently filled with detergent, softener, or an additive pod 230, respectively. In particular, the open position may permit receipt of an additive pod 230 (e.g., provided by a user) within pod compartment 225). From the open position, front panel 228 may be then be pushed back into mixing chamber 220 (i.e., to the closed position) before a wash cycle begins. Along with permitting water into the compartments 222, 224, 225, the closed position of additive dispenser 200 may restrict or inhibit user access to the compartments 222, 224, 225.

Although the illustrated embodiments show detergent compartment 222, softener compartment 224, and pod compartment 225 slidably received in mixing chamber 220 for receiving wash additives, one skilled in the art will appreciate that different configurations are possible in alternative exemplary embodiments. For example, mixing chamber 220 may exclusively rely on an included pod compartment 225 such that sliding compartments 222, 224, 225 are not needed. Other configurations of mixing chamber 220 and compartments 222, 224, 225 are also possible and within the scope of the present disclosure.

Additive dispenser 200 may further include one or more valves configured to supply hot or cold water to mixing chamber 220. For example, according to the illustrated embodiment, a plurality of apertures may be defined on top 202 of mixing chamber 220 (e.g., on shower plate 260) for receiving water. Each receiving aperture may be in fluid communication with a different portion of the mixing chamber 220. A plurality of valve seats may be positioned over top of each of those apertures to receive a valve that controls the flow of water through each receiving aperture.

For example, a first valve seat 234 may be in fluid communication with a first aperture for providing hot water into detergent compartment 222 or pod compartment 225. A second valve seat 236 may be in fluid communication with a second aperture for providing cold water into detergent compartment 222 or pod compartment 225. A third valve seat 238 may be in fluid communication with a third aperture for providing cold water into softener compartment 224. A fourth valve seat 240 may be in fluid communication with a fourth aperture for providing cold water into mixing chamber 220 or directly into wash tub 121. Optionally, an internal switching valve (not pictured) may be provided within additive dispenser 200 to selectively direct water between detergent compartment 222 and pod compartment 225.

Water inlets may be placed in fluid communication with each of valve seats 234, 236, 238, 240. More specifically, a hot water inlet 244 may be connected to a hot water supply line (not shown) and a cold water inlet 246 may be connected to a cold water supply line (not shown). According to the illustrated embodiment, each water inlet 244, 246 may include a threaded male adapter configured for receiving a threaded female adapter from a conventional water supply line. However, any other suitable manner of fluidly connecting a water supply line and water inlets 244, 246 may be used. For example, each water supply line and water inlets 244, 246 may have copper fittings that may be sweated together to create a permanent connection.

Notably, hot water inlet 244 is in direct fluid communication with first valve seat 234. However, because washing machine appliance 100 uses cold water for multiple purposes, cold water inlet is in fluid communication with a cold water manifold 248. Cold water manifold 248 may be a cylindrical pipe that extends along the lateral direction from second valve seat 236 to fourth valve seat 240. In this manner, cold water manifold 248 places valve seats 236, 238, 240 in fluid communication with cold water inlet 246.

Each of valve seats 234, 236, 238, 240 may be configured to receive a water valve 252 for controlling the flow of water through a corresponding aperture into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through first valve seat 234 and from cold water manifold 248 through one or more of second valve seat 236, third valve seat 238, and fourth valve seat 240.

Additive dispenser 200 may further include one or more supply conduits (e.g., water supply conduit 264) defining an internal water inlet (e.g., water inlet 266) within a specific compartment to direct water to that specific compartment (e.g., from one or more of the valves 252 or valve seats 234, 236, 238, 240). For example, when second valve seat 236 is open, water may flow from cold water inlet 246 through cold water manifold 248 and second valve seat 236 into water supply conduit 264 and then pod compartment 225. As will be described in greater detail below, water may dissolve an additive pod 230 placed within pod compartment 225 upstream from wash tub 121 to create a wash liquid to be dispensed downstream from mixing chamber 220 and into wash tub 121.

One or more nozzles (not shown) may be provided in additive dispenser 200 for directing wash fluid, such as water or a mixture of water and at least one fluid additive (e.g., detergent, fabric softener, or bleach) into wash tub 121 from additive dispenser 200. A nozzle (not shown) may be placed on the bottom of mixing chamber 220 (e.g., on or through a bottom surface of base plate 262) to dispense the wash fluid into wash tub 121. Moreover, it will be understood that different nozzle configurations may be used in alternative exemplary embodiments. For example, nozzles may be positioned on a bottom of mixing chamber 220 near wash tub 121 or directly on wash tub 121, as well as other suitable locations.

Turning especially to FIGS. 4 through 8, an exemplary drawer frame 212 of additive dispenser 200 is illustrated. As noted above, drawer frame 212 generally defines a pod compartment 225 to receive an additive pod 230 therein. Moreover, drawer frame 212 may be slidably mounted to mixing chamber 220 (e.g., shower plate 260 and base plate 262) to move relative thereto (e.g., along the transverse direction T). When assembled, pod compartment 225 is positioned downstream from (i.e., in downstream fluid communication with) water inlet 266 defined by water supply conduit 264.

As shown, drawer frame 212 includes an internal sidewall 268 that at least partially encloses and defines pod compartment 225. For example, internal sidewall 268 may extend in the vertical direction V from an internal base wall 270 (e.g., as an integral or unitary molded member). While a bottom portion of sidewall 268 is joined to base wall 270, the top portion of sidewall 268 may define an opening through which a user may place an additive pod 230. Thus, base wall 270 and sidewall 268 may together define pod compartment 225 and receive additive pod 230 therein.

Generally, sidewall 268 and pod compartment 225 extend along the transverse direction T between a front end 272 and a rear end 274; and along the lateral direction L between a first side 276 and a second side 278. When received within pod compartment 225, an additive pod 230 may thus be enclosed or bounded by sidewall 268 between front end 272 and rear end 274, as well as between first side 276 and second side 278. In the open position, front end 272 is understood to be distal to mixing chamber 220 or shower plate 260 (e.g., along the transverse direction T), while rear end 274 is understood to be proximal to mixing chamber 220 or shower plate 260. In optional embodiments, a sealing gasket 279 may extend above sidewall 268 (e.g., at front panel 228) to engage a front portion of shower plate 260 and restrict the flow of wash fluid above sidewall 268.

In some embodiments, front end 272 defines a pair of adjacent concave surfaces 280A, 280B facing pod compartment 225 (e.g., such that the pair of concave surfaces 280A, 280B is directed towards pod compartment 225 along the transverse direction T). One concave surface 280A is positioned proximal to first side 276 while the other concave surface 280B is positioned proximal to second side 278. As shown, the pair of adjacent concave surfaces 280A, 280B may be directly joined to each other. Moreover, an interior wedge 282 may be formed between the pair of concave surfaces 280A, 280B (e.g., along the lateral direction L) as a shared vertex formed by the abutment between the pair of concave surfaces 280A, 280B. In some such embodiments, the interior wedge 282 extends inward relative to pod compartment 225 (e.g., in the direction of rear end 274). In particular, the interior wedge 282 may be positioned closer to the rear end 274 than a concave vertex 284A, 284B of each concave surface 280A, 280B. Thus, interior wedge 282 may be positioned rearward relative to each concave vertex 284A, 284B. In certain embodiments, each concave surface 280A, 280B is formed as a mirrored image of the other (e.g., about the interior wedge 282). Thus, each concave vertex 284A, 284B may be located at the same location along the transverse direction T (e.g., while still be spaced apart along the lateral direction L).

A wash fluid outlet 286 is defined at or by the rear end 274 of sidewall 268 (e.g., in horizontal or transverse alignment with interior wedge 282). When assembled, wash fluid outlet 286 is positioned in fluid communication between pod compartment 225 and wash tub 121 (FIG. 2). In other words, wash fluid outlet 286 may be downstream from water inlet 266 and pod compartment 225, while also being upstream from wash tub 121 and the nozzles of additive dispenser 200. For instance, wash fluid outlet 286 may be defined as an aperture that is horizontal or perpendicular to the vertical direction V. In the illustrated embodiments, wash fluid outlet 286 is generally defined along the transverse direction T through sidewall 268. Optionally, wash fluid outlet 286 may have a lateral width or diameter that is greater than the width or diameter of water supply conduit 264. Moreover, water supply conduit 264 may be aligned with and selectively received through wash fluid outlet 286. For instance, when additive dispenser 200 is in the closed position, water supply conduit 264 may extend through wash fluid outlet 286 and into pod compartment 225 (e.g., along the transverse direction T). In other words, the closed position may permit greater receipt of water supply conduit 264 than the open position. In some such embodiments, water supply conduit 264 coaxial with and within wash fluid outlet 286. In further embodiments, wash fluid outlet 286 is aligned with water inlet 266 (e.g., along the transverse direction T).

In optional embodiments, a drain notch 287 is further defined through rear end 274 and may, for example, extend along the vertical direction V from wash fluid outlet 286 to base wall 270. During use, excess wash fluid or water remaining within pod compartment 225 may thus drain to mixing chamber 220 or wash tub 121 (FIG. 2) through drain notch 287. In additional or alternative embodiments, one or more portions of pod compartment 225 are defined at an angle (e.g., non-orthogonal or non-parallel) relative to the vertical direction V. As an example, sidewall 268 at front end 272 may extend upward from base wall 270 along a non-parallel angle relative to the vertical direction V (e.g., an acute angle such that sidewall 268 at front end 272 is generally inclined toward wash fluid outlet 286). As another example, base wall 270 may extend downward along a non-orthogonal angle relative to the vertical direction V from front end 272 to rear end 274.

Figure 4:
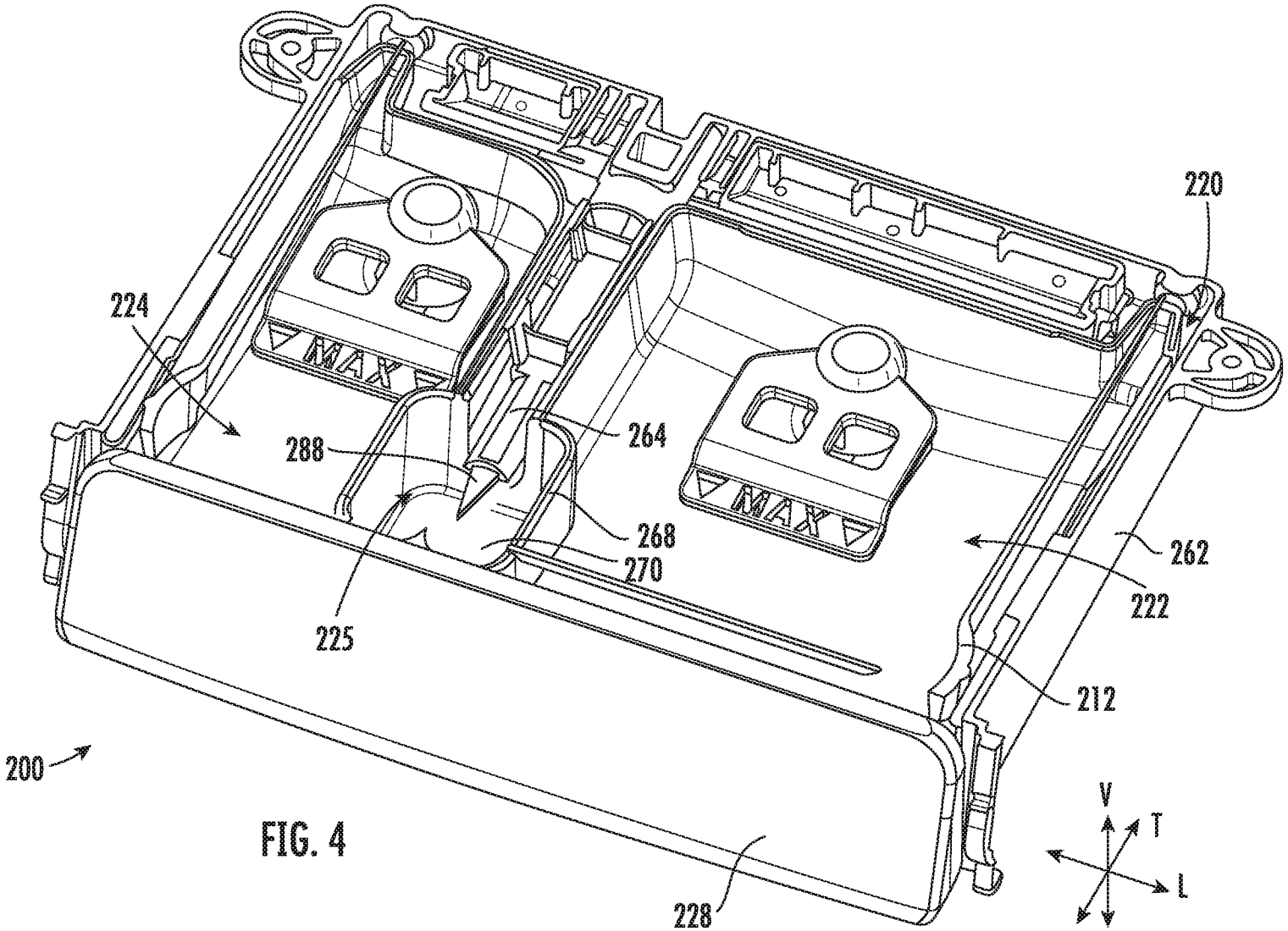
FIG. 4 provides a front, perspective view of a portion of the exemplary additive dispenser of FIG. 3.
Figure 5:
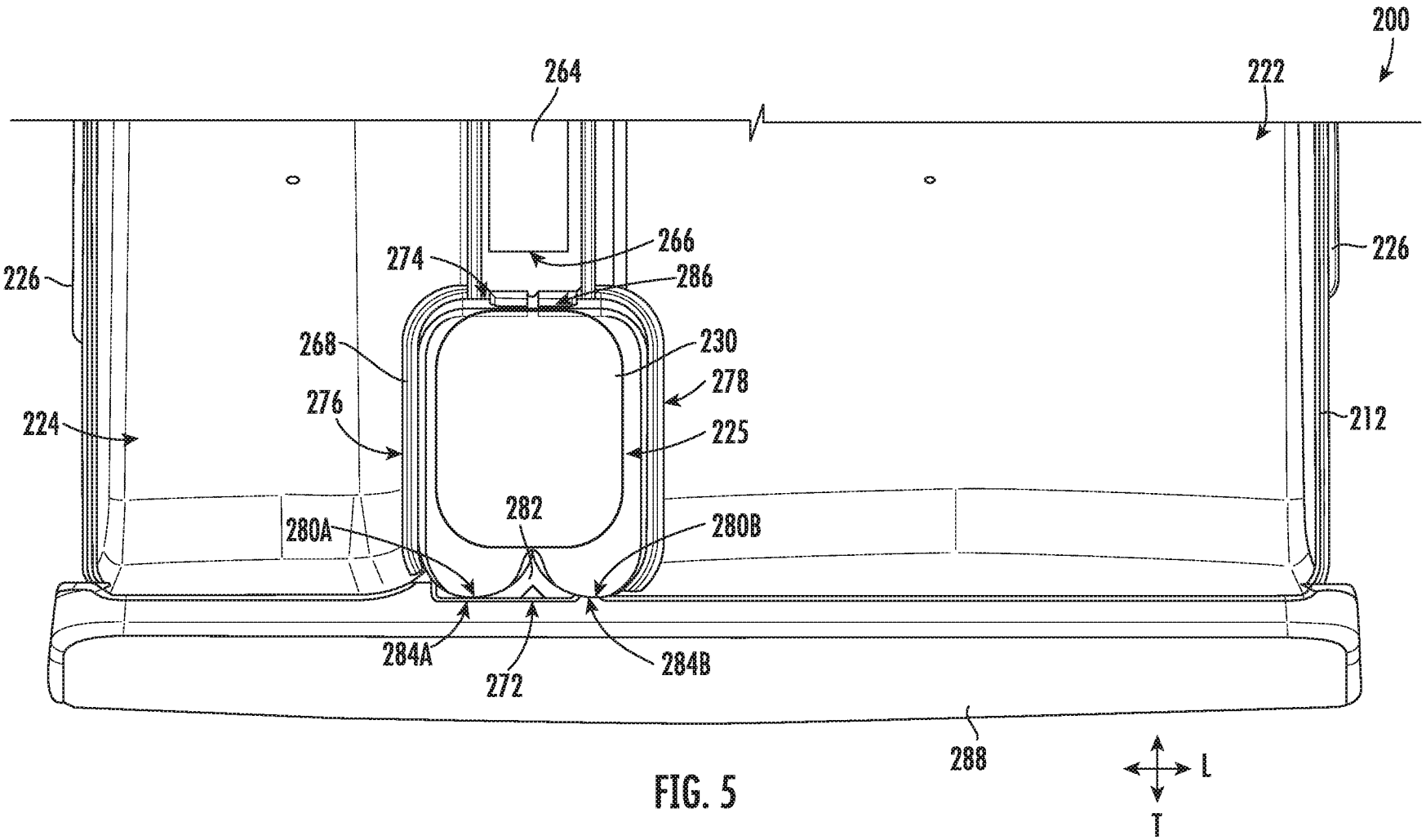
FIG. 5 provides a top, perspective view of a mixing chamber of an additive dispenser according to exemplary embodiments of the present disclosure.
Figure 6:
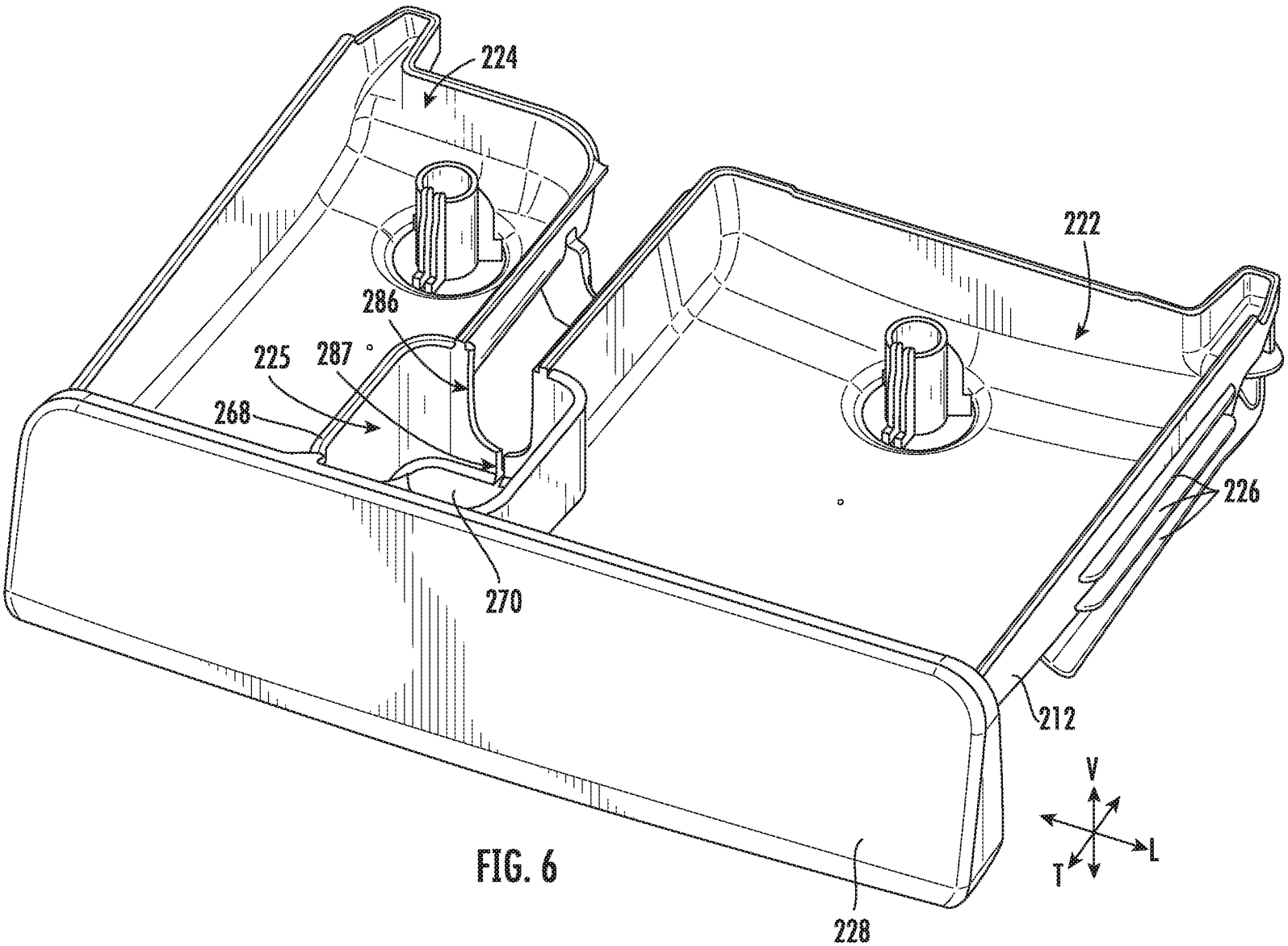
FIG. 6 provides a front, perspective view of the exemplary mixing chamber of FIG. 5.
Figure 7:
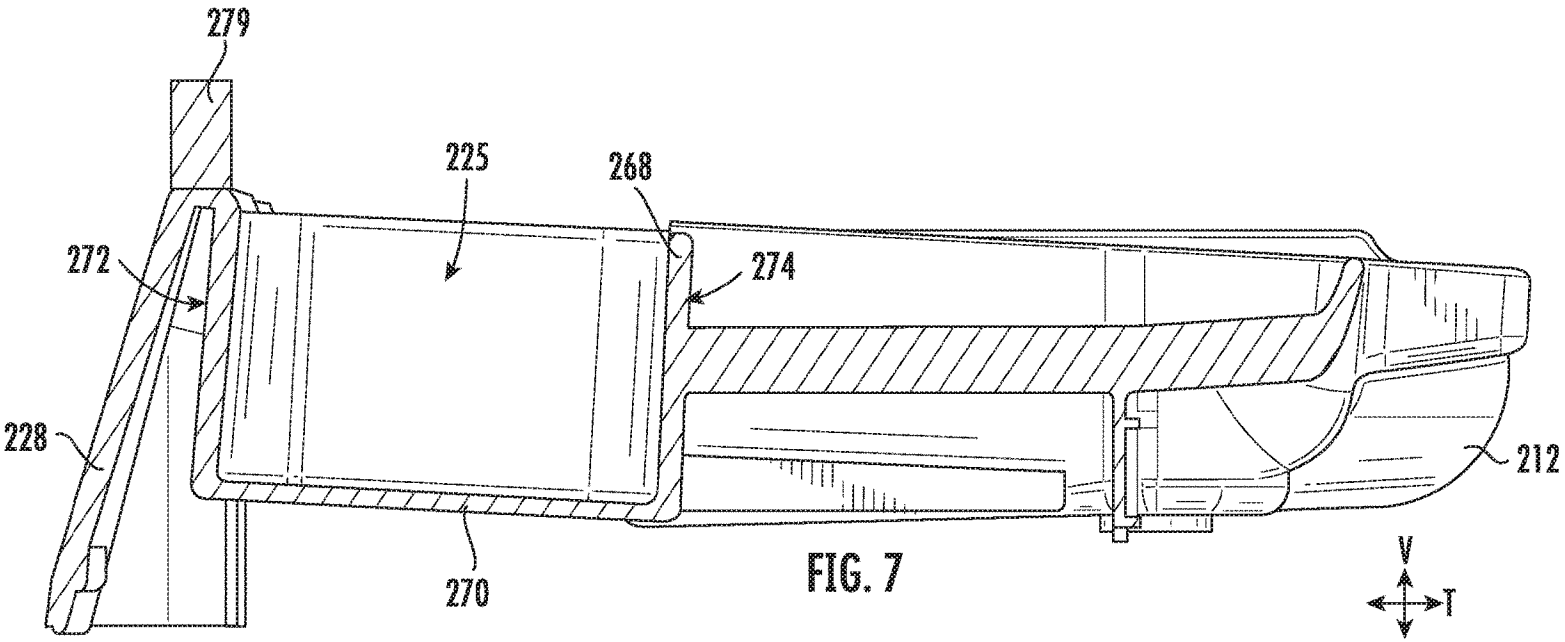
FIG. 7 provides a side, cross-sectional view of the exemplary mixing chamber of FIG. 5.
Figure 8:
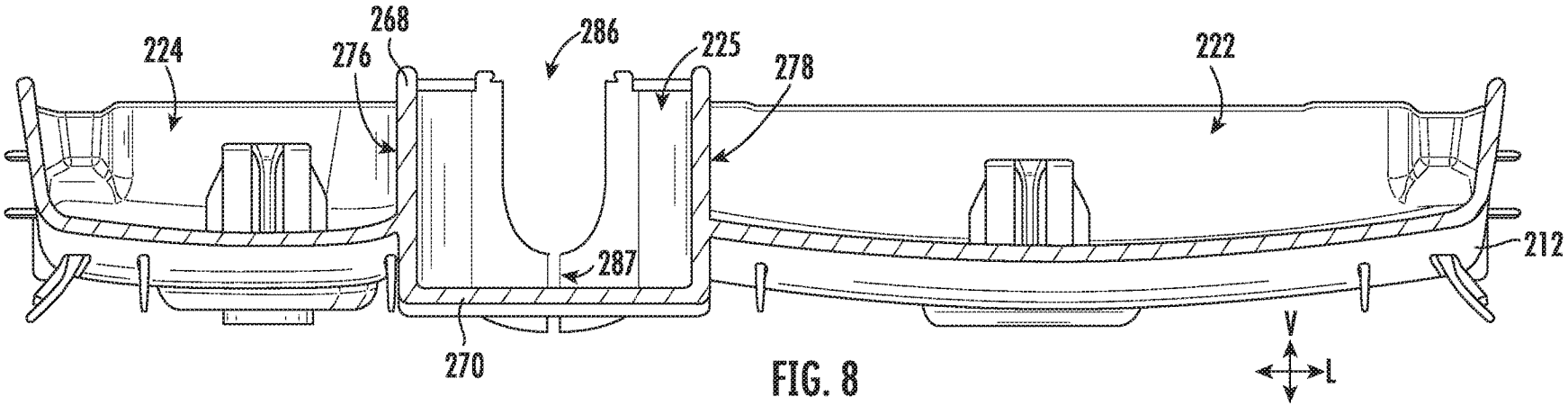
FIG. 8 provides a front, cross-sectional view the exemplary mixing chamber of FIG. 5.
Figure 9:
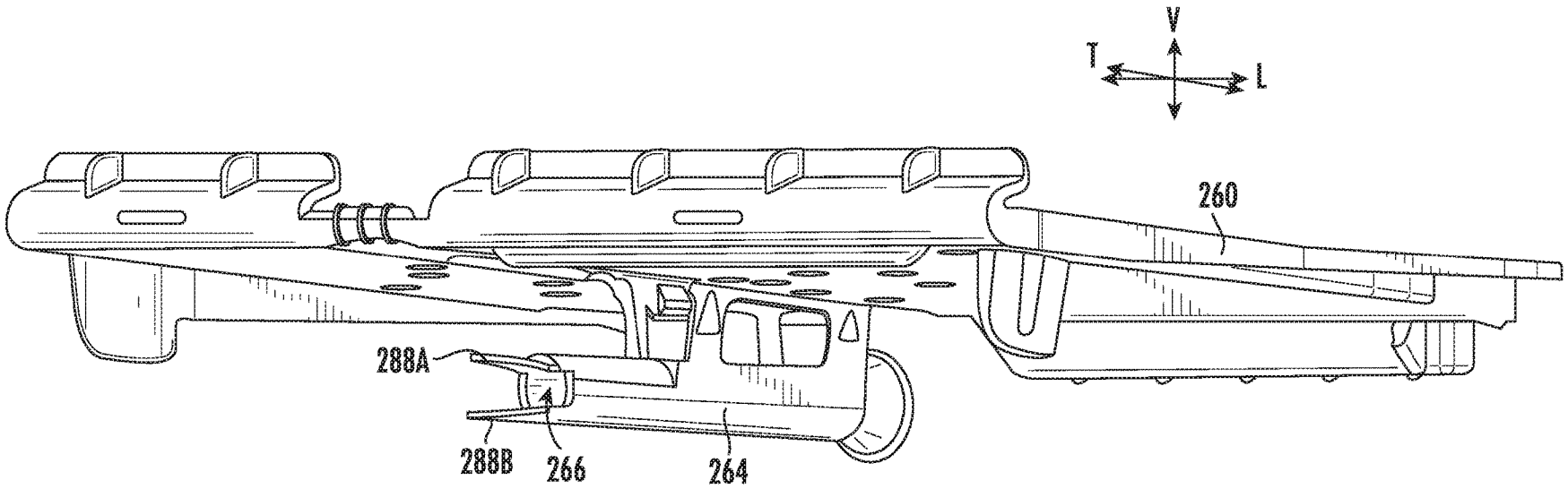
FIG. 9 provides a front, perspective view of a shower plate of an additive dispenser according to exemplary embodiments of the present disclosure.
Figure 10:
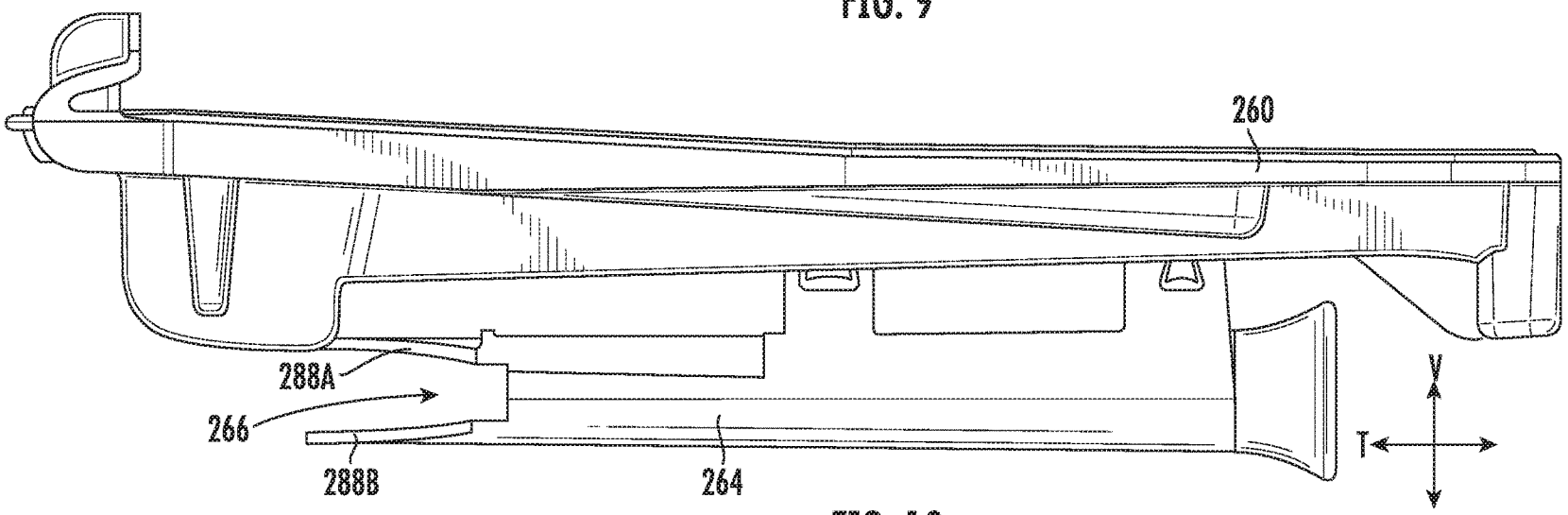
FIG. 10 provides a side, perspective view of the exemplary shower plate of FIG. 9.

Turning briefly to FIGS. 4, 9, and 10, in some embodiments, water supply conduit 264 is fixed relative to mixing chamber 220 or wash tub 121 (FIG. 2). For instance, water supply conduit 264 may be fixedly mounted to shower plate 260. Thus, drawer frame 212 may be movable relative to water supply conduit 264. If wash fluid outlet 286 is aligned with water supply conduit 264, water supply conduit 264 may selectively pass through wash fluid outlet 286 (e.g., as drawer frame 212 slides from the open position to the closed position). In some such embodiments, in the open position, water supply conduit 264 is held outside of pod compartment 225 or wash fluid outlet 286; in the closed position, water supply conduit 264 is received within pod compartment 225 and wash fluid outlet 286. Advantageously, water supply conduit 264 may be hidden or otherwise held apart from any portion of additive dispenser 200 that a user may contact (e.g., during normal use of washing machine appliance 100—FIG. 2). In other words, a user may be prevented from accidentally contacting or disturbing water supply conduit 264 during normal operations.

Turning now generally to FIGS. 11 through 16, various embodiments of pod compartment 225 are illustrated between an open position of additive dispenser 200 and a closed position of additive dispenser 200. Although FIGS. 11 through 16 primarily illustrate pod compartment 225 and water supply conduit 264, it is understood that these exemplary embodiments may include one or all of the features of the embodiments described above. Moreover, it is understood that, except as otherwise indicated, each of the illustrated embodiments may include one or more of the same features.

Advantageously, the illustrated embodiments encourage mixture of wash additive(s) and water within pod compartment 225. Moreover, the illustrated embodiments promote accelerated an improved dissolution of additive pod 230 within a pod compartment 225, even in the presence of relatively cold water from water inlet 266. Furthermore, the illustrated embodiments may advantageously permit the use of multiple additive pods (e.g., stacked along the transverse direction T).

Figure 11:
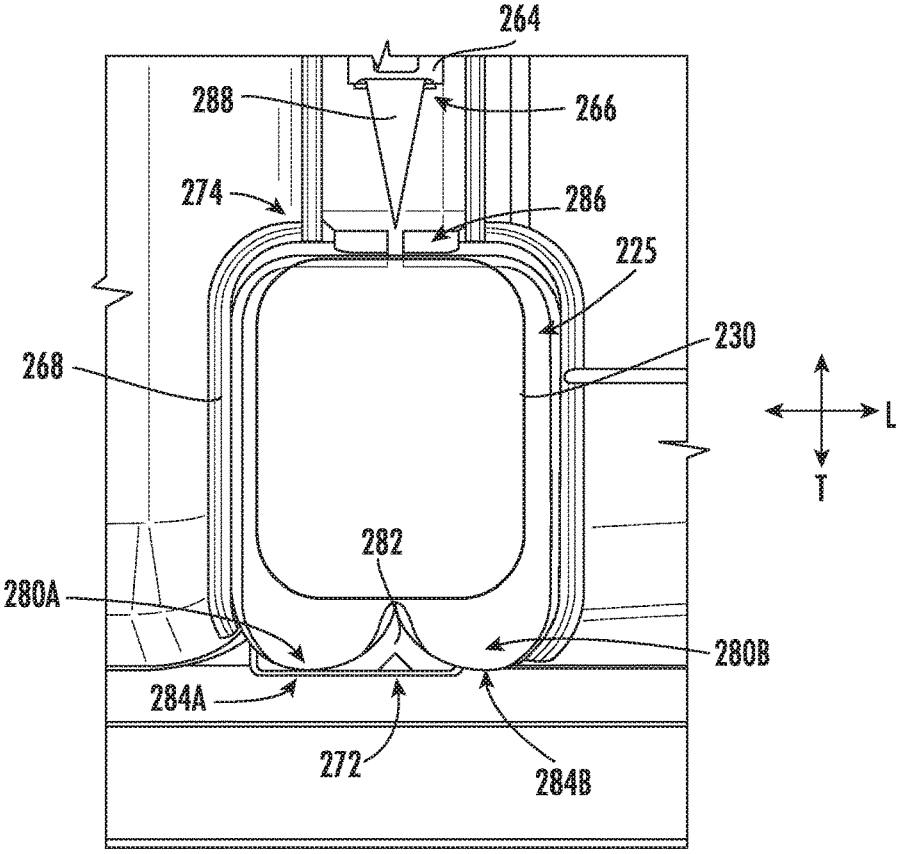
FIG. 11 provides a top, perspective view of a compartment of an additive dispenser in an open position according to exemplary embodiments of the present disclosure.
Figure 12:
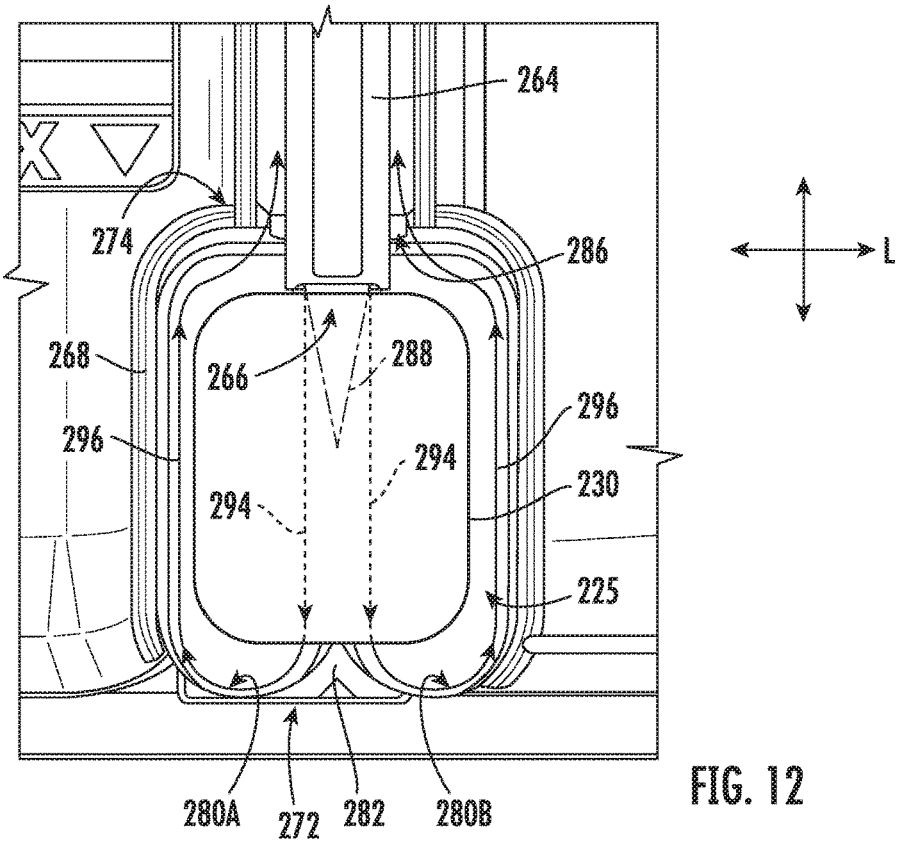
FIG. 12 provides a top, perspective view of the compartment of the exemplary additive dispenser of FIG. 11 in a closed position.

In certain embodiments, such as those illustrated in FIGS. 11 and 12 (see also FIGS. 9 and 10), water supply conduit 264 includes a needle tip 288 extending forward from (or defining a portion of) water inlet 266. As shown, needle tip 288 generally provides a tapered body sharpened to a point (e.g., forwardmost point). Optionally, needle tip 288 may include multiple tapered bodies and sharpened points, such as an upper tapered body 288A and a lower tapered body 288B, as shown in FIGS. 9 and 10. In the closed position, needle tip 288 may pierce or puncture an additive pod 230 within pod compartment 225. Specifically, movement of pod compartment 225 from the open position to the closed position may force additive pod 230 against needle tip 288 such that needle tip 288 is forced into additive pod 230 and creates a flow path for water into or through additive pod 230.

In some embodiments, water inlet 266 is aligned with the interior wedge 282 (e.g., along the transverse direction T). During use, water may flow directly from water inlet 266 and through the punctured portion of additive pod 230 (e.g., as illustrated at arrows 294). Within pod compartment 225, water and wash additives may mix together as additive pod 230 dissolves. Moreover, the flow of fluid through additive pod 230 may propel or force fluid against the pair of concave surfaces 280A, 280B and toward wash fluid outlet 286 at rear end 274 (e.g., as illustrated at arrows 296).

Figure 13:
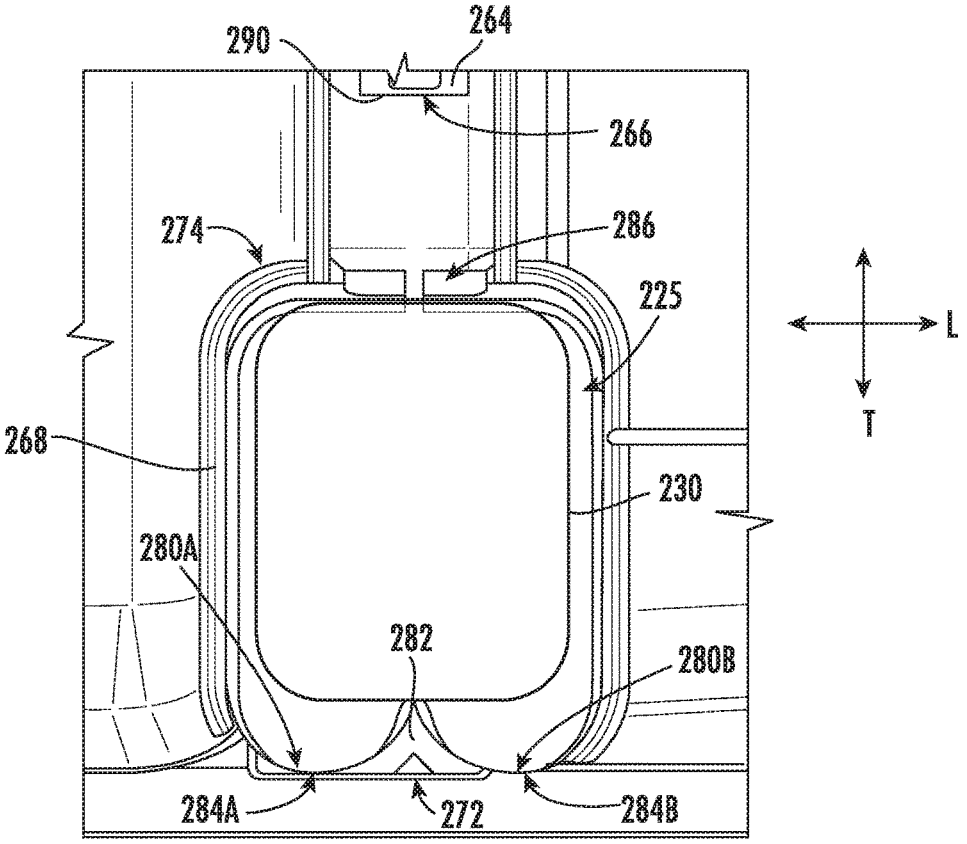
FIG. 13 provides a top, perspective view of a compartment of an additive dispenser in an open position according to exemplary embodiments of the present disclosure.
Figure 14:
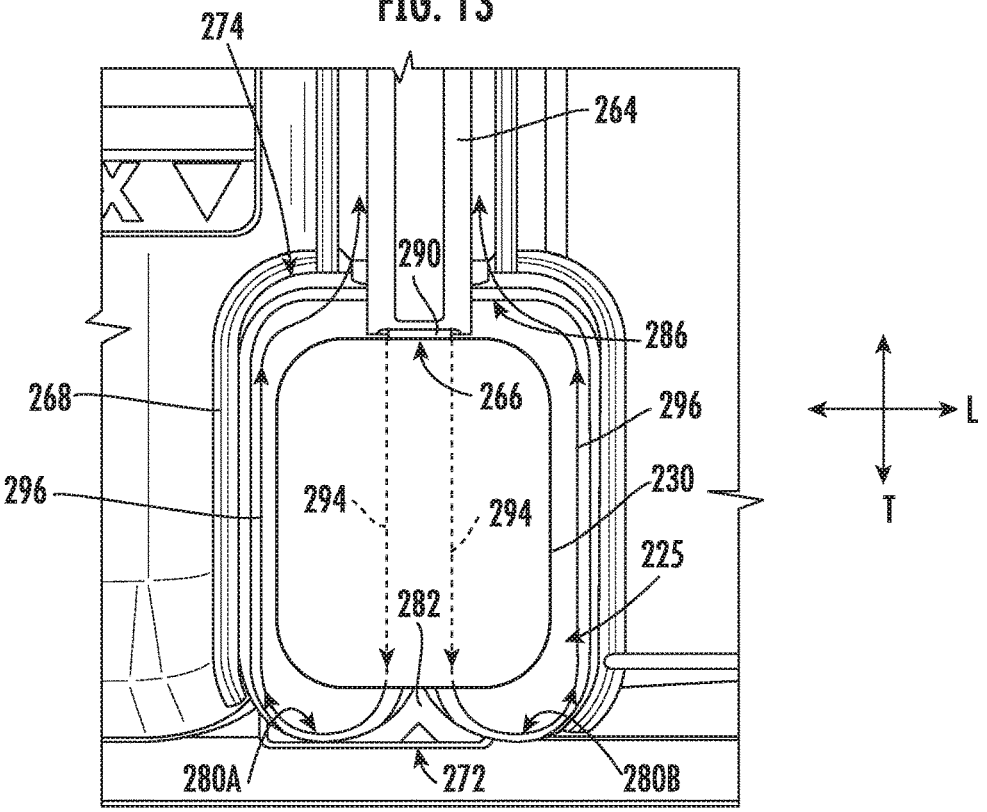
FIG. 14 provides a top, perspective view of the compartment of the exemplary additive dispenser of FIG. 13 in a closed position.

In alternative embodiments, such as those illustrated in FIGS. 13 and 14, water supply conduit 264 includes a flat impingement tip 290 at water inlet 266. As shown, flat impingement tip 290 generally provides a constant diameter or otherwise non-tapered body. In the closed position, flat impingement tip 290 extends to or within pod compartment 225 and may abut (e.g., contact) an additive pod 230 within pod compartment 225. Specifically, movement of pod compartment 225 from the open position to the closed position may force additive pod 230 against flat impingement tip 290 without immediately puncturing any portion of additive pod 230. However, the flow of water through water inlet 266 may cause the abutting portion of additive pod 230 to puncture or dissolve, and thereby create a flow path for water into or through additive pod 230.

In some embodiments, water inlet 266 is aligned with the interior wedge 282 (e.g., along the transverse direction T). During use, water may flow directly from water inlet 266 and through the punctured or dissolved portion of additive pod 230 (e.g., as illustrated at arrows 294). Within pod compartment 225, water and wash additives may mix together as additive pod 230 dissolves. Moreover, the flow of fluid through additive pod 230 may propel or force fluid against the pair of concave surfaces 280A, 280B and toward wash fluid outlet 286 at rear end 274 (e.g., as illustrated at arrows 296).

Figure 15:
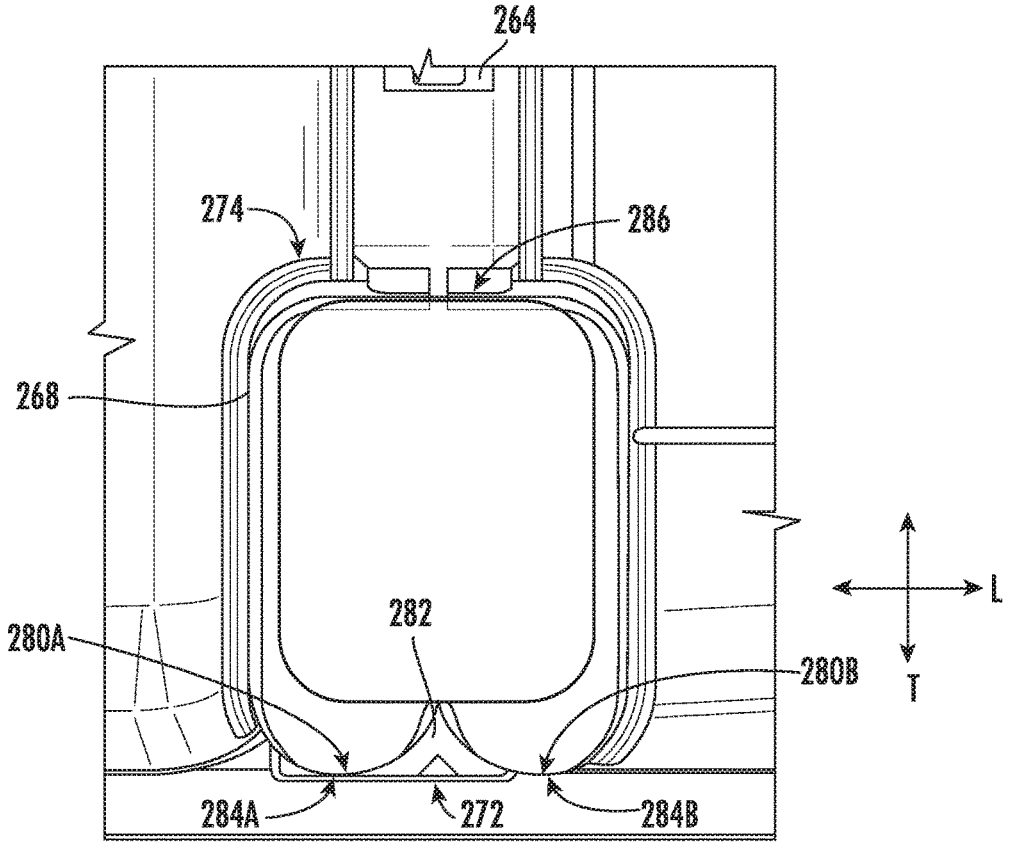
FIG. 15 provides a top, perspective view of a compartment of an additive dispenser in an open position according to exemplary embodiments of the present disclosure.
Figure 16:
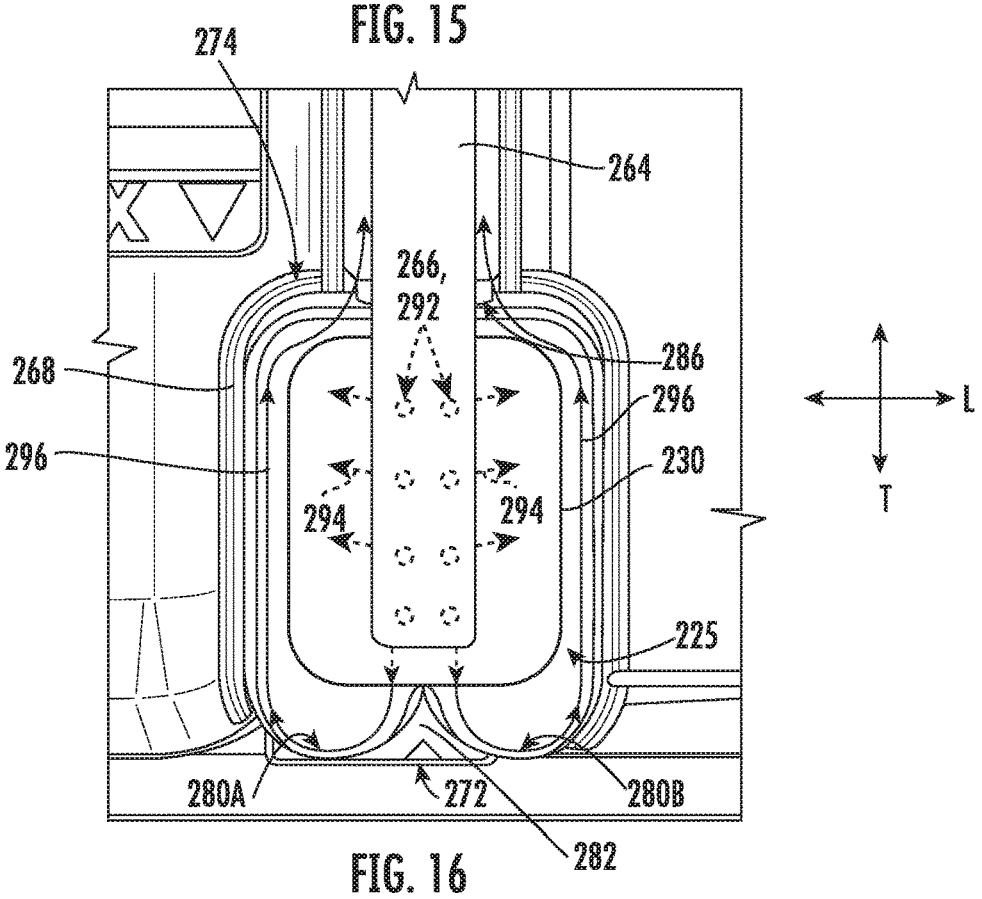
FIG. 16 provides a top, perspective view of the compartment of the exemplary additive dispenser of FIG. 15 in a closed position.

In further alternative embodiments, such as those illustrated in FIGS. 15 and 16, water supply conduit 264 defines a plurality of water apertures 292 (e.g., extending along the vertical direction V—FIG. 8) as part of water inlet 266. In the closed position, the plurality of water apertures 292 may be held above additive pod 230 such that a spray of water (e.g., a volume of water) may be directed downward against additive pod 230. In such embodiments, water inlet 266 may thus be positioned above the interior wedge 282 (e.g., along the transverse direction T) or additive pod 230. During use, water may flow down against and through additive pod 230 (e.g., as indicated at arrows 294). Within pod compartment 225, water and wash additives may mix together as additive pod 230 dissolves. Moreover, the flow of fluid through additive pod 230 may propel or force fluid against the pair of concave surfaces 280A, 280B and toward wash fluid outlet 286 at rear end 274 (e.g., as illustrated at arrows 296).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An additive dispenser for a washing appliance for providing a wash fluid to a wash chamber of the washing appliance, the additive dispenser comprising:

a water inlet positioned upstream from the wash chamber; and a drawer frame defining a compartment to receive an additive pod, the compartment being positioned in downstream fluid communication with the water inlet on a flow path extending along a transverse direction from the water inlet, the drawer frame comprising a sidewall at least partially enclosing the compartment, the sidewall extending along the transverse direction between a front end and a rear end, the sidewall extending along a lateral direction between a first side and a second side, the front end defining a pair of adjacent concave surfaces facing the compartment, the pair of adjacent concave surfaces forming an interior wedge positioned rearward relative to a concave vertex of each concave surface, and the rear end defining a wash fluid outlet positioned in fluid communication between the compartment and the wash chamber, wherein the water inlet is coaxial along the transverse direction with the wash fluid outlet, and wherein the water inlet is defined by a water supply conduit selectively received through the wash fluid outlet.

2. The additive dispenser of claim 1, wherein the wash fluid outlet is aligned with the interior wedge along the transverse direction.

3. The additive dispenser of claim 1, wherein the water inlet is aligned with the interior wedge along the transverse direction.

4. The additive dispenser of claim 1, wherein the water supply conduit is fixedly mounted to a shower plate, and wherein the drawer frame is slidably mounted on the shower plate to selectively move thereon along the transverse direction.

5. The additive dispenser of claim 1, wherein the interior wedge comprises a shared vertex formed by an abutment between the pair of adjacent concave surfaces.

6. The additive dispenser of claim 1, wherein the water supply conduit comprises a needle tip extending forward from the water inlet to puncture the additive pod within the compartment.

7. An additive dispenser for a washing appliance for providing a wash fluid to a wash chamber of the washing appliance, the additive dispenser comprising:

a water inlet positioned upstream from the wash chamber;

a drawer frame defining a compartment to receive an additive pod, the compartment being positioned in downstream fluid communication with the water inlet, the drawer frame comprising a sidewall at least partially enclosing the compartment, the sidewall extending along a transverse direction between a front end and a rear end, the sidewall extending along a lateral direction between a first side and a second side, the front end defining a pair of adjacent concave surfaces facing the compartment, the pair of adjacent concave surfaces forming an interior wedge positioned rearward relative to a concave vertex of each concave surface, and the rear end defining a wash fluid outlet positioned in fluid communication between the compartment and the wash chamber and coaxial along the transverse direction with the water inlet; and a water supply conduit defining the water inlet positioned upstream from the wash chamber, wherein the drawer frame is horizontally slidable relative to the water supply conduit between an open position and a closed position, the open position permitting receipt of the additive pod within the compartment, the closed position permitting greater receipt of the water supply conduit in the compartment than the open position.

8. The additive dispenser of claim 7, wherein the water supply conduit comprises a needle tip extending forward from the water inlet to puncture the additive pod within the compartment.

9. The additive dispenser of claim 7, wherein the wash fluid outlet is aligned with the interior wedge along the transverse direction.

10. The additive dispenser of claim 7, wherein the water inlet is aligned with the interior wedge along the transverse direction.

* * * * *